US005372692A

United States Patent [19]

Sakamoto et al.

[11] Patent Number: 5,372,692

[45] Date of Patent: Dec. 13, 1994

[54] BIPOLAR ELECTROLYTIC CELL

[75] Inventors: Kenji Sakamoto; Akira Hironaga, both of Shinnanyo, Japan

[73] Assignee: Tosoh Corporation, Shinnanyo, Japan

[21] Appl. No.: 70,745

[22] Filed: Jun. 3, 1993

[30] Foreign Application Priority Data

Jun. 3, 1992 [JP] Japan ..... 4-166699

[51] Int. Cl.[5] ..... C25B 9/00

[52] U.S. Cl. ..... 204/268; 204/288; 204/289

[58] Field of Search ..... 204/268, 286, 289, 288

[56] References Cited

U.S. PATENT DOCUMENTS 4,116,805 9/1978 Ichisaka et al. ..... 204/268 X
4,464,242 8/1984 Boulton ..... 204/289 X
4,767,519 8/1988 de Nora ..... 204/289 X
4,869,800 9/1989 Hofmann et al. ..... 204/289 X

*Primary Examiner*—Donald R. Valentine
*Attorney, Agent, or Firm*—Foley & Lardner

[57] ABSTRACT

A bipolar electrolytic cell includes an anode-side partition having protrusions on the anode side which are electrically connected to the anode through conductive members, or recesses formed by causing the anode-side partition to protrude on the cathode side.

Use of this bipolar electrolytic cell enables the conductor resistance on the anode side to be small, allows the anode to be easily replaced when its activity as a catalyst has been deteriorated, and makes it possible to effect easy and economic repairs even when trouble has occurred during operation.

12 Claims, 3 Drawing Sheets

BIPOLAR ELECTROLYTIC CELL

BACKGROUND OF THE INVENTION

1. Field of the Invention

This invention relates to a novel bipolar electrolytic cell in which the conductor resistance of electrolytic cell is very small, replacement of the deteriorated anode is easy, and damage to the electrolytic cell is very slight when trouble occurs.

Use of such a bipolar electrolytic cell reduces the requisite electrolytic voltage for electrolysis, facilitates the replacement of a deteriorated anode, and greatly simplifies the repair of the electrolytic cell when trouble occurs.

2. Description of the Related Art

There are various known electrolytic cell structures for industrial electrolysis of brine, etc. In industrial electrolysis, a reduction in electrolytic voltage is naturally important. From this viewpoint, it is desirable for conductor resistance of the electrolytic cell to be small. Further, it is desirable for the electrolytic-cell structure in which the anode can be easily replaceable when it deteriorates as a result of degradation, damage, etc. Also, it is desirable for the electrolytic-cell structure to be minimally liable to damage when trouble occurs.

The related art of the present invention will be described with reference to an electrolytic cell used in electrolysis of an alkali chloride aqueous solution.

In the method commonly referred to as the "ion-exchange membrane salt electrolysis" method, electrolysis is performed on brine by using a fluorine-containing cation-exchange membrane to produce chlorine at the anode, and caustic soda and hydrogen at the cathode. As is generally well known, this method provides a higher energy efficiency than that of the conventional mercury or diaphragm method and also enables a caustic soda of a higher purity to be produced than that of the conventional mercury or diaphragm method.

In recent years, there is an increasing demand for energy saving, with the result that it is becoming more and more necessary to realize a still higher energy efficiency for salt electrolysis by the ion exchange membrane method. In view of this, a technique is being developed which makes it possible to conduct salt electrolysis with a lower electrolytic voltage and/or a higher current efficiency.

Usually, salt electrolysis is conducted with an electrolytic voltage which is as much as 1V or more higher than the theoretical electrolytic voltage of approximately 2.2V. As is well known, this is attributable to the overvoltages at the anode and at the cathode, and to the increase in voltage due to the various resistance components, such as membrane resistance, solution resistance and conductor resistance. That is, to achieve a reduction in electrolytic voltage, it is important to realize a reduction in the anode overvoltage, cathode overvoltage, membrane resistance, solution resistance, electrolytic-cell conductor resistance, etc.

At present, an electrode consisting of a titanium base coated with a catalyst having a low-chlorine overvoltage characteristic, such as ruthenium oxide, has been put into practical use and is being widely used as the anode. For the cathode, various electrodes having a low-hydrogen overvoltage characteristic have been devised and put into practical use. Due to these techniques, the anode and cathode overvoltages have been overcome to a considerable degree.

Since the catalytic activity at the anode gradually deteriorates as electrolysis proceeds, it is necessary to replace the electrode catalyst by a new one after long use. Usually, the replacement of the electrode catalyst at the anode is carried out by replacing the anode with a new one.

As a cation exchange membrane, a fluorine-containing cation exchange membrane is in use which consists of a fluorine-resin body combined with carboxylic acid and/or sulfonic acid groups as fixed ions. This membrane has been improved by reducing the electrolytic voltage and enhancing the current efficiency and durability. As a result, it has been considerably improved as far as reduction in membrane resistance and enhancement in current efficiency are concerned.

Thus, in recent years, all attempts to improve electrolytic cells have been directed to reducing the solution and conductor resistances through an improved electrolytic method, an improved electrolytic cell, etc. As a means for attaining a reduction in solution resistance, a method has been proposed according to which electrolysis is conducted with the cathode and the anode being set as close as possible to each other; that is, the membrane and the anode are placed in close contact, and so are the cathode and the membrane. To mitigate the increase in electrolytic voltage due to adhesion to be membrane surface of the bubbles generated during electrolysis, a membrane is generally used which has undergone a bubble-opening treatment so as to prevent adhesion of bubbles to the membrane surface on the anode and/or cathode surface.

Electrolytic cells for industrial use are roughly divided into monopolar and bipolar types. In comparison with the monopolar type, the bipolar type electrolytic cell has a number of advantages. For example, its structure can be made relatively simple since it does not require wiring for each cell. Further, since it does not need a large current, the rectifier, bus bar, etc. can be compact and inexpensive. Thus, it leads to a great industrial advantage to achieve a reduction in conductor resistance in bipolar electrolytic cells.

Conductor resistance greatly depends on the structure, material, etc. of the electrolytic cell. That is, conductor resistance is determined by the path of current through the electrolytic cell and by the specific resistance of the electrolytic cell material used in the path of current. Therefore, it is possible to attain a reduction in conductor resistance by making the current path as short as possible and/or employing a material having a small-specific resistance for the current-path portion of the cell.

However, an electrolytic cell for alkali-chloride electrolysis has a problem in that while its cathode may be made of a material having a relatively small specific resistance, such as nickel or an iron-based alloy, its anode is generally formed of a material such as-titanium or a titanium-based alloy, which, though these materials have good durability against chlorine gas, has a relatively large specific resistance. Further, in a conventional bipolar electrolytic cell, a substantially flat titanium plate is used for the partition on the anode side, and the partition and the anode are electrically and mechanically connected to each other by means of conductive ribs made of titanium. Further, to ensure a passage for uniformalizing the solution in the anode chamber and for discharging the generated chlorine gas to the exterior of the electrolytic cell, a gap of 30 to 50 mm is generally required between the anode and the partition on the anode side.

That is, in the conventional bipolar electrolytic cell, an increase in voltage occurs due to the so called conductor resistance when current flows through the conductive ribs on the anode side, which has a large specific resistance. In view of this, there has been a demand for a bipolar electrolytic cell capable of reducing, in particular the conductive resistance on the anode side.

In order to meet this demand, the present applicant proposed, in Japanese Patent Laid-Open No. 58-71382, an electrolytic cell in which, with a view toward reducing the conductor resistance of the electrolytic cell, the cathode and anode chambers were made of a thin plate of a corrosion-resistant metal having a corrugated surface configuration.

FIGS. 4 and 5, on page 5 of the above laid-open publication supplied sectional views of an electrolytic cell according to a preferred embodiment of that invention. The electrical connection between the cathode and anode chambers of that electrolytic cell was realized by pressure welding, thereby eliminating the voltage loss which would have been involved if a connector had been used. Further, since the anode was directly connected to protrusions of the partition on the anode side, it was also possible to eliminate the voltage loss which would have been involved if conductive ribs had been used. Thus, the above invention, made by the present applicant and disclosed in the above laid-open publication, has made it possible to attain a substantial reduction in what is called conductive resistance.

However, the present inventors found the following serious problem with the above electrolytic cell when they used it in electrolysis of an alkali chloride.

The partition on the anode side is liable to be damaged when the anode is detached and replaced with a new one after the electrode catalyst has deteriorated after long use. Further, the attachment of the new anode requires much effort. In addition, after a long period of alkali-chloride electrolysis, pin holes are generated in the ion exchange membrane, which may lead to considerable corrosion of the cell portions around the pin holes, e.g., the anode, and the partition on the anode side. Such damage on the anode side of the electrolytic cell can only be made good by entirely replacing the anode-side partition of the electrolytic cell with a new one, which requires much effort and material.

SUMMARY OF THE INVENTION

This invention has been made with a view toward solving the above problems. It is accordingly an object of this invention to provide a bipolar electrolytic cell in which the conductor resistance on the anode side is small, which enables the anode to be easily replaced when its activity as a catalyst has been deteriorated, and which allows easy and economic repairs even when trouble has occurred during operation.

In accordance with this invention, there is provided a bipolar electrolytic cell comprising an anode-side partition having protrusions on the anode side, the protrusions being electrically connected to the anode through conductive members, or a bipolar electrolytic cell further comprising recesses formed by causing the anode-side partition to protrude on the cathode side.

Use of a bipolar electrolytic cell according to the present invention enables electrolysis to be conducted with low voltage due to the small conductor resistance on the anode side, allows the replacement of the anode to be easily effected, and makes it possible to repair any damage to the electrolytic cell very easily and economically, such damage being very slight even if pin holes are generated in the membrane.

DETAILED DESCRIPTION OF THE PREFERRED EMBODIMENTS

The structure of the electrolytic cell of this invention will now be described with reference to the drawings, which are only presented as some preferred embodiments of this invention and, consequently, should not be construed restrictively. A bipolar electrolytic cell in itself is quite familiar to those skilled in the art, so only the features of this invention will be described in detail, with reference to a bipolar electrolytic cell for electrolysis of alkali chloride aqueous solutions. The drawings do not show such components as electrolytic-solution supply/discharge nozzles or a cathode, which may be of the same material and structure as those in conventional bipolar electrolytic cells and incorporated in an appropriate manner into the electrolytic cell of this invention.

Figure 1:
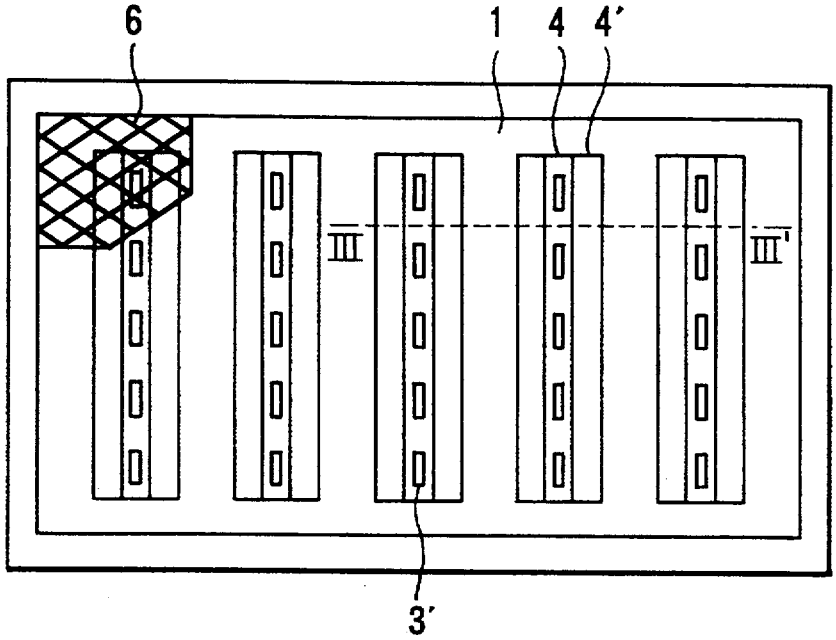
FIG. 1 is a plan view of an electrolytic cell according to an embodiment of this invention.
Figure 2:
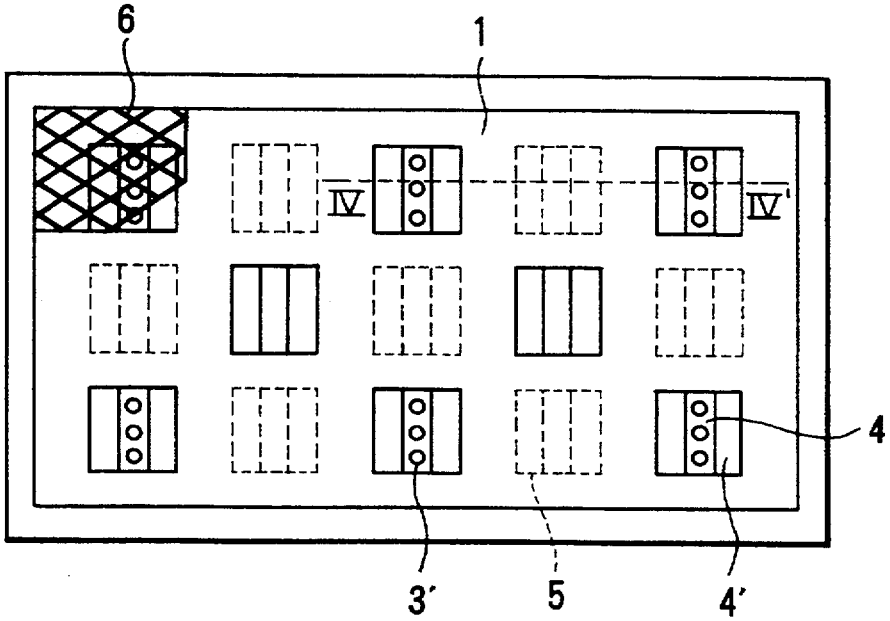
FIG. 2 is a plan view of an electrolytic cell according to another embodiment of this invention.
Figure 3:
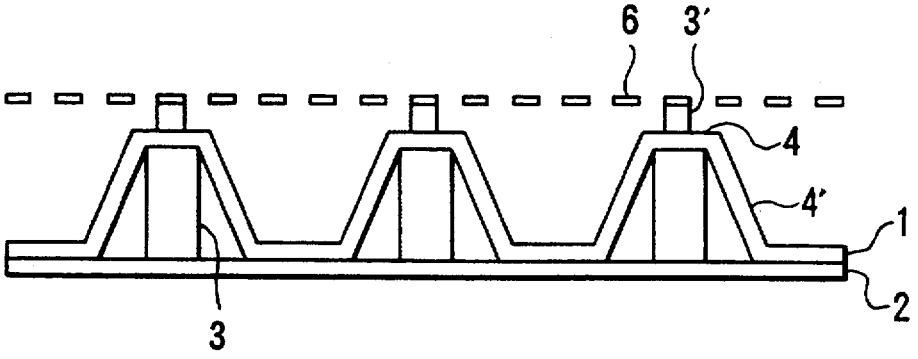
FIG. 3 is a sectional view taken along line A–A′ of FIG. 1.
Figure 4:
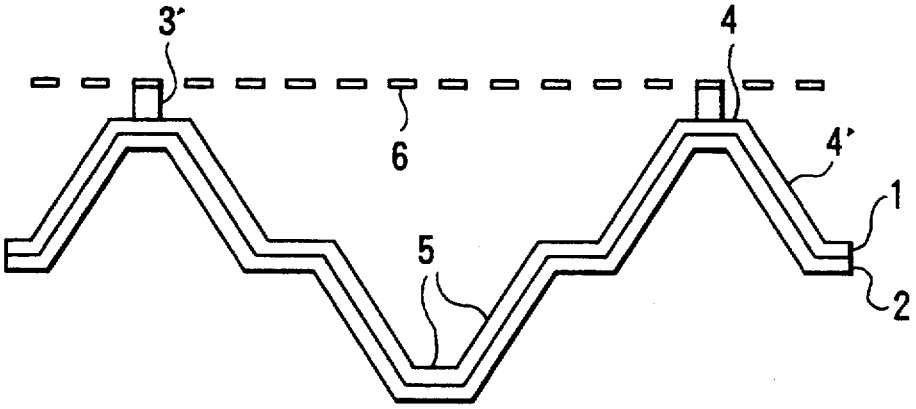
FIG. 4 is a sectional view taken along line B–B′ of FIG. 2.

FIGS. 1 and 2 show examples of the bipolar-electrolytic cell structure preferably adopted in the present invention. FIGS. 3 and 4 show the relationship between the anode side partition, the cathode side partition and the anode in these examples.

In the drawings, numeral 1 indicates the anode-side partition, which is generally made of a flat plate of titanium or a titanium-based alloy. Numeral 2 indicates the cathode-side partition, which is generally made of a flat plate of stainless steel, nickel or the like. It is essential in this invention for the anode side partition 1 to have protrusions (4+4′) protruding toward the anode 6. (4 shows protruded plane and 4′ shows inclined plane as shown in, for example, FIG. 1.) It is also possible for the anode-side partition 1 to have protrusions 5 directed toward the cathode (not shown).

To attain a more effective reduction in conductor resistance and to enhance the mechanical strength of the electrolytic cell, conductive members 3 may be provided between the anode side partition 1 and the cathode side partition 2.

Further, it is essential for other conductive members 3′ to be provided between the anode side partition 1 and the anode 6. It is desirable that at least the anode-side surface of the partition 1 be made of titanium or a titanium-based alloy. For example, the partition 1 may be formed of a titanium thin plate or of a clad material consisting of titanium and a good conductor other than titanium. Examples of the good conductor other than titanium include copper, copper-based alloys, iron, and iron-based alloys. When the partition consists of a clad material composed of titanium and a material other than titanium, the titanium portion naturally comes on the anode side.

The height of the protrusions (4+4') or the difference in vertical dimension between the protruded planes (4) and the recesses 5, is preferably not less than 10 mm and not more than 70 mm. The flat sections of the anode side partition 1 or the recesses 5 serve as passages for the electrolytic solution and gas, so that if the above height or difference in vertical dimension is less than 10 mm, the voltage reducing effect obtained will be rather small. On the other hand, if it is over 70 mm, the width of the electrolytic cell becomes exceedingly large, resulting in an undesirable increase in conductor resistance, installation area, and material cost per cell.

The protrusions (4+4') may have the same or different configurations. Further, while the protrusions (4+4') may protrude substantially in the vertical direction as shown, another preferred embodiment of this invention adopts protrusions inclined at an angle preferably not more than 45° with respect to the vertical direction. However, an inclination angle of beyond 45° would result in bubbles staying on the protrusions, thereby negatively affecting the electrolytic properties of the cell.

Also, it is not necessary for the protrusions and recesses to be formed continuous in the vertical direction. Rather, it is more desirable for them to be separated into upper and lower parts since that enables the electrolytic-solution components in the cell to be mixed to a more sufficient degree. This may be attained, for example, with the configuration as shown in FIG. 2.

As for the configuration of the protruded planes 4 there is no particular restrictions; they may be rectangular, parallelogrammic, polygonal, circular, elliptical, etc.

Figure 5:
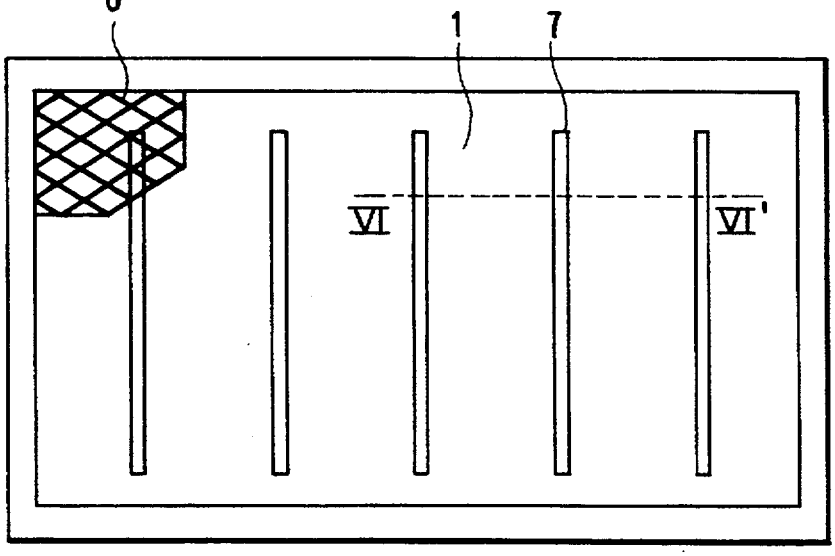
FIG.5 PRIOR ART
FIG. 5 is a plan view of a conventional bipolar electrolytic cell which has generally been used.
Figure 6:
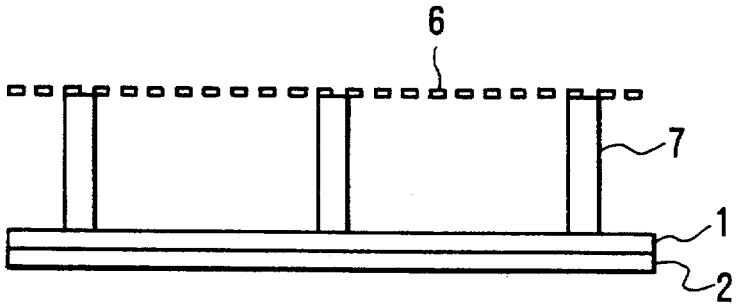
FIG.6 PRIOR ART
FIG. 6 is a sectional view taken along the line C–C′ of FIG. 5.

FIGS. 5 and 6 show a conventional bipolar electrolytic cell and the relationship between the anode side partition, cathode-side partition, and anode thereof.

Conductive ribs 7 are attached to the anode-side partition 1, and the anode 6 is attached to the conductive ribs 7. As stated above, the conductive ribs 7 are generally made of titanium or a titanium-based alloy; when electricity is applied to these conductive ribs, an increase in voltage due to conductor resistance occurs. Accordingly, to attain a reduction in electrolytic voltage, it is desirable for the conductive ribs to be made as short as possible. However, since the passages for discharging the electrolytic solution and chlorine gas to the exterior of the electrolytic cell are provided on the back surface of the anode, a gap of generally 30 to 50 mm must be provided between the back surface of the anode and the anode-side partition.

At least a part of the anode side partition 1 is electrically connected to the cathode-side partition 2, which is made of nickel, iron or the like. The cathode-side partition 2 is joined to the cathode (not shown) by means of conductive ribs (not shown).

In the present invention, it is desirable for the ratio of the total area of the protruded planes 4 which are parallel to the anode to the effective electrolytic area be in the range of not less than 5% and not more than 60%. If the ratio is less than 5%, an increase in conductor resistance occurs, resulting in a degeneration of the effect of this invention; the ratio is therefore preferably not less than 15%. On the other hand, if the ratio is more than 60%, the condition in which the electrolytic solution is supplied will deteriorate, and the generated gas will be allowed to stay, resulting in an increase in electrolytic voltage and/or a deterioration in current efficiency and, in some cases, even damage to the membrane.

Regarding the cathode-side partition 2, it may be formed by using a material which has been conventionally adopted, and there is no particular restriction as to its configuration. For example, it may be a flat plate or have protrusions and recesses like the anode side partition. When protrusions and recesses are provided on the cathode-side partition, the protrusions on the cathode side are defined in the same way as those on the anode-side partition. The configuration of these cathode-side protrusions may be the same as that of the anode-side ones or differ therefrom.

The surface portion of the cathode-side partition may be formed of nickel or a nickel-based alloy, which arrangement is desirable in that it especially helps to restrain corrosion during electrolysis. The cathode-side partition may be made of nickel or a nickel-based alloy alone, or it may be formed of a composite material formed by providing a nickel or nickel-based-alloy layer on the surface of an iron or iron-alloy base by plating or thermal spraying. In the latter case, the nickel or nickel-based-alloy layer is positioned on the cathode side.

It is essential for at least part of the anode-side partition 1 and the cathode-side partition 2 to be electrically joined to each other. In this regard, it is desirable for at least a part of this electrical junction to be realized in the form of a junction between the inner surface of a protrusion of the anode-side partition and the surface of the cathode-side partition.

In the example shown in FIG. 3, which is a sectional view taken along the line A–A' of FIG. 1, the cathode-side partition 2 is substantially flat, whereas the anode-side partition 1 has protrusions.

As shown in FIG. 3, the top section of the inner surface of each protrusion of the anode side partition 1 is electrically connected to the inner surface of the cathode side partition 2 thorough a conductive member 3 joined to the inner surface of the cathode-side partition 2 in such a way as to be substantially vertical thereto. It is desirable for the conductive members 3 to have a small electric resistance; they are preferably made of copper, nickel, iron or an alloy containing at least one of these metals.

In addition to the junctions described above, the anode-side and cathode-side partitions may be further joined together at other positions. That would enhance the mechanical strength of the partitions. For example, the direct joint between flat sections of the anode-side partition and the cathode-side partition would enhance the mechanical strength of the partitions.

It is essential for the proturuded planes 4 of the anode side partition 1 and the anode 6 to be electrically connected together through the intermediation of conductive members 3'. Thus, if a direct connection is made between the proturuded planes 4 on the anode side partition 1 and the anode 6, with no conductive members 3' therebetween, no special benefit of the present invention would be realized.

In the example shown in FIG. 4, which is a sectional view taken along the line B–B' of FIG. 2, the cathodeside partition 2 and the anode-side partition 1 have the same configuration.

In this example, it is desirable for at least the proturuded planes 4 of the anode side partition 1 to be electrically connected to the cathodeside partition 2. This connection may be effected through the intermediation of the conductive members 3. If, as shown in FIG. 4, the proturuded planes 4 on the anode side are directly connected to the back surface of the cathode side partition 2, a remarkable reduction in conductor resistance can be desirably attained. Another desirable method is to electrically connect the entire inner surface of the anode-side partition 1 to the cathode side partition 2.

The electrical connection between the anode side and cathode side partition 1 and 2 can be realized by spot welding, explosion bonding or the like. It is also desirable to adopt a composite member formed by joining together the anode side and cathode side partitions by pressure welding, which composite member is shaped into a desired configuration after being joined together. Further, it is also possible for a titanium plate and a nickel plate to be shaped into a desired configuration by press working or the like.

It is essential in this invention for the protruded planes 4 of the anode-side partition 1 and the anode 6 to be electrically connected together through the conductive members 3'. If a direct connection is made between the protruded planes 4 on the anode side partition 1 and the anode 6, with no conductive members 3' used therebetween, would no special benefit of the present invention would be realized.

Figure 7:
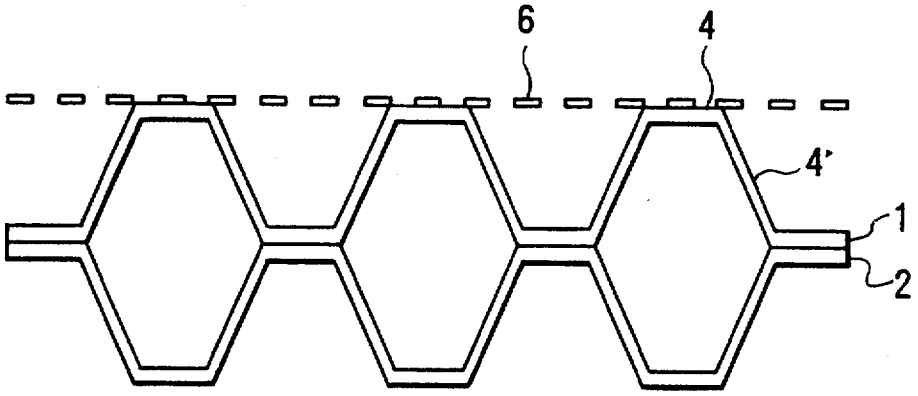
FIG.7 PRIOR ART
FIG. 7 is a sectional view of a conventional electrolytic cell having protrusions.
Figure 8:
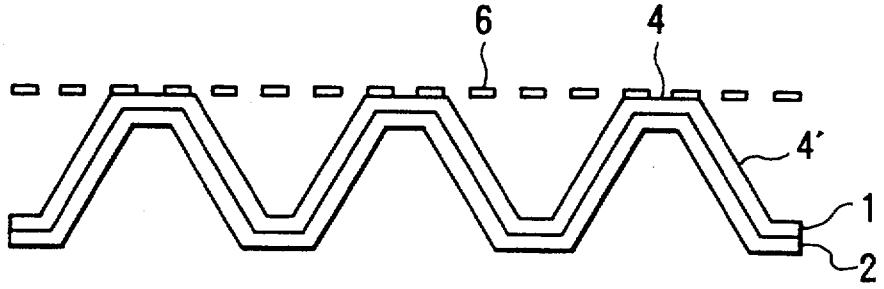
FIG.8 PRIOR ART
FIG. 8 as a sectional view of another conventional electrolytic cell.

FIGS. 7 and 8 are sectional views showing conventional electrolytic cells having protrusions and recesses on the anode-side partition. In these conventional examples, the protruded planes (4+4') on the anode side partition are directly joined to the anode 6, which leads to various problems. For example, the anode side partition is liable to be damaged. Thus, the special benefit of the present invention cannot be expected from these conventional examples.

However, it goes without saying that the above conventional electrolytic cells, shown in the sectional view of FIGS. 7 and 8, can be turned into an electrolytic cell structure according to one of the preferred embodiments of the present invention by effecting an electrical connection between the anode-side partition and the anode through the intermediation of the conductive members 3'.

The material for the conductive members 3' should exhibit, apart from conductivity, a sufficient level of durability since it is exposed in the anode chamber, where electrolysis is conducted. In view of this, it is desirable for at least the surface portion of the conductive members 3' to be made of titanium or a titanium-based alloy. The conductive members 3' may also include an inner portion made of a good conductor such as copper. Thus, the conductive members 3' may be square or round bars of titanium, or square or round clad materials in the form of titanium bars including inner copper portions.

Further, one or a plurality of conductive members 3' may be used for each protruded planes 4. It is desirable for the projected area of the conductive members 3' on the protruded planes 4 account for 70% or less of the area of the latter. If this projected area accounts for more than 70%, a deterioration in the electrolytic solution supply condition occurs in this section, which not only results in an increase in voltage and/or a reduction in current efficiency but also causes the membrane to be negatively affected. On the other hand, it is desirable for the projected area to account for not less than 5%; a projected-area proportion of less than 5% would mean excessively thin conductive members 3', which would result in an increase in conductor resistance.

Further, when the anode-side partition is joined to the anode through the intermediation of the conductive members 3', the distance between the protruded planes 4 of the anode-side partition and the back surface of the anode is preferably set at 2 mm or more, and more preferably, 3 mm or more. When the distance is less than 2 mm, the anode-side partition 1 is liable to be damaged, resulting in the special benefit of the present invention not being fully realized. As long as the distance is 2 mm or more, the special benefit of the present invention can be utilized. However, making the distance excessively large would result in an increase in the installation area of the electrolytic cell itself and, further, in an increase in conductor resistance. Thus, the distance is preferably not more than 10 mm and, more preferably, not more than 5 mm.

Any existing anode for alkali chloride electrolysis is applicable to the electrolytic cell of the present invention. For example, it is possible to use an anode in which an electrode catalyst layer of ruthenium oxide or the like, which has low chloride overvoltage characteristics, is formed on a titanium base. Further, use of an electrode in the form of a porous plate, which is not particularly restricted in terms of configuration, desirably enables the generated chlorine gas to be discharged through the back surface of the anode to the exterior of the cell. Electrodes of such a configuration are widely known as "punched metals", "expanded metals" or "mesh electrodes".

The junction between the cathode side partition and the cathode can be realized by any conventionally known method. For example, when the cathode-side partition is substantially in the form of a flat plate, as in the case of FIG. 3, the junction between the cathode side partition and the cathode can be effected by means of conductive ribs arranged in such a way as to define a gap of 10 to 50 mm between the partition and the cathode. All the conventionally known conductive ribs are applicable for the purpose.

When, as in the case of FIG. 4, the cathode-side partition is formed of a material having protrusions and recesses, it is possible for a direct electrical connection to be realized between the recesses 5 on the anode side and the cathode. Further, if necessary, an electrical connection can be effected through conductive members as in the case of the anode.

In the electrolytic cell of this invention, a remarkable reduction in electrolytic voltage can be attained through provision of an active cathode having low hydrogen overvoltage characteristics. Such an active cathode can be obtained forming an active nickel layer by plating on the surface of an electrode of iron, an iron based alloy, nickel or a nickel-based alloy.

A method of producing such an active cathode is disclosed, for example, in Japanese Patent Laid-Open No. 58-6983. When installing such an active cathode, it is desirable that the cathode and all the other components inside the cathode chamber be subjected to the active-cathode plating process after the cathode is joined to the partition.

Next, a method for electrolysis of an alkali-chloride aqueous solution by using the above bipolar electrolytic cell will be described. There are various known methods for electrolysis of alkali chloride aqueous solutions. In the present invention, it is possible to select an appropriate method from these known methods.

For example, a plurality of the above bipolar electrolytic cells are arranged in series, with partitions being provided between the anodes and cathodes to define anode and cathode chambers. The number of cells arranged, which is not particularly restricted, is usually approximately 5 to 30. While it is desirable to use fluorine-containing cation exchange membranes for the partitions, it is also possible to adopt the so-called diaphragm method in which an asbestos membrane or the like is used.

Further, although it is possible for a certain gap to be provided between the anodes and the associated membranes and between the cathodes and the associated membranes, it is more desirable to place them in contact since that will help to mitigate the solution resistance. It is desirable for the cation exchange membranes be ones which have undergone bubble opening treatment on the anode-side surfaces and/or the cathode side surfaces. Such cation exchange membranes are generally known.

A refined alkali chloride solution is supplied to the anode chambers, and pure water and/or a caustic alkali solution is supplied to the cathode chambers. While it is possible for each chamber to be individually supplied with solution, a parallel supply system is usually adopted.

There are no particular restrictions as to the concentrations of the solutions supplied. Usually, the concentration of the alkali-chloride solution ranges from 230 g/lit. to saturation, and the concentration of the caustic alkali solution is set at 32 wt/% or less.

Current is supplied in series from the anode at the extreme end to the cathode at the extreme end. As electrolysis proceeds, chlorine and diluted alkali-chloride solution are discharged from the anode chambers, and hydrogen and caustic alkali are discharged from the cathode chambers. While the discharge can be effected entirely on an individual basis, it is usually effected in parallel on anode and cathode systems. After refining processes, the chlorine and the hydrogen are obtained as products. Regarding the diluted alkali chloride solution, part of it is usually caused to recirculate, and the remaining part is disposed of, or in some cases, reutilized. Part of the caustic alkali is usually caused to recirculate, and the remaining part thereof is obtained as a product after a concentration process, etc.

There are no particular restrictions as to the concentration of the discharged diluted alkali-chlorine solution and that of the discharged caustic alkali. Usually, the concentration of the diluted alkali chlorine is set to the range of 230 ~170 g/lit., and the concentration of the caustic alkali is set to the range of 20 wt % to 50 wt %.

There are no particular restrictions regarding the density of the electrolytic current; usually, it is approximately 1 ~7 $KA/m^2$.

There are no particular restrictions regarding the electrolytic temperature; usually, it is approximately 75°~100° C.

As described above, use of a bipolar electrolytic cell according to this invention helps to attain a reduction in electrolytic voltage due to the reduced conductor resistance on the anode side, facilitates the replacement of the anode whose catalytic activity has been degenerated, and allows the electrolytic cell to be repaired easily and economically if trouble has occurred during operation.

It is needless to say that the bipolar electrolytic cell of the present invention is not restricted to the electrolysis of alkali-chloride solutions but also applicable to other fields of industrial electrolysis.

In comparison with the conventional well-known electrolytic cells, the novel bipolar electrolytic cell of the preset invention provides various advantages, which can be summarized as follows:

First, the conductor resistance of the electrolytic cell of this invention is small, which makes it possible to achieve a reduction in electrolytic voltage. This can be clearly seen by comparing the electrolytic cells of this invention shown in FIGS. 1 and 2 with that shown in FIG. 5, which is a typical example of the conventional electrolytic cells. In the electrolytic cell of FIG. 5, the electrical connection between the anode side partition and the anode was realized by means of conductive ribs made of titanium. Since the supply of electricity to the anode is effected by passing current through these ribs of titanium, which have a relatively large specific resistance, a great voltage drop occurs there. Accordingly, the conductor-resistance loss involved accounts for a large proportion of the electrolytic voltage.

In the electrolytic cell of this invention, in contrast, the electrical connection between the anode-side partition and the anode is effected solely by the conductive members 3', which have a very small length. Therefore, the voltage loss due to the conductor resistance between the anode-side partition and the anode can be reduced extremely. As a result, a reduction in electrolytic voltage can be achieved. Since the anode-side and cathode-side partitions are electrically connected by cell sections made of copper or nickel, the conductor resistance therebetween is negligible.

Secondly, the anode can be easily replaced with a new one when its catalytic activity has been degenerated after long use. That is, in the electrolytic cell of this invention, the anode-side partition 1 and the anode 6 are joined together through the intermediation of conductive members, so that there is no danger of the partition being damaged during the anode replacement process. In addition, the removal and attachment of anodes can be easily conducted.

Thirdly, unlike the conventional electrolytic cells as shown in FIGS. 7 and 8, which were presented as an example of the prior art technique as disclosed in Japanese Patent Laid-Open No. 58-71382, the electrolytic cell of the present invention adopts a structure in which the anode-side protruded planes 4 and the anode 6 are connected through the conductive members 3', so that the area of the anode holes blocked by the protruded planer 4 of the anode side partition is relatively small. As a result, the cell section between the anode and the membrane is supplied with a sufficient amount of electrolytic solution as are the other cell sections, and no chlorine gas stays there, so that there is no danger of this section of the membrane being negatively affected. Further, even if pin holes are generated in the membrane, the anode-side partition is not corroded at all since in the electrolytic cell of this invention the anode side partition 1 is spaced apart from the membrane by 2 mm or more; it is only the anode or the conductive members 3' electrically connecting the anode and the partition that are corroded. Thus, when repairing the cell, it is only necessary to replace the corroded anode and/or conductive members 3' thus substantially reducing the repairing cost and greatly facilitating the repairing operation.

Thus, through the provision of the conductive members 3′ on the protruded planes 4 of the anode side partition, the corrosion due to any trouble can be reduced to an amazing degree. It will be appreciated from this that the electrolytic cell of this invention provides a far more excellent performance than the conventional electrolytic cells.

In conclusion, it should be remarked that the design of the electrolytic cell of this invention and the effects it provides, were conceived when the present inventors found that the influence of any caustic corrosion leaking into the anode chamber only extends over a range of approximately 1 mm as from the back surface of the anode toward the anode side partition.

What is claimed is:

1. A bipolar electrolytic cell comprising an anode, a cathode, and an anode-side partition, said anode-side partition having at least one protrusion on the anode side, said protrusion being electrically connected to the anode through conductive members, said conductive members being provided between said anode side partition and said anode.

2. A bipolar electrolytic cell according to claim 1 wherein the distance between the protrusion of the anode-side partition and the back surface of said anode ranges from 2 mm to 10 mm.

3. A bipolar electrolytic cell according to claim 1 wherein the ratio of a total area of the protrusion to an effective-electrolytic area is ranges from not less than 5% to not more than 60%.

4. A bipolar electrolytic cell according to claim 1, wherein said anode-side partition has a recess formed by causing said anode-side partition to protrude on the cathode side.

5. A bipolar electrolytic cell according to claim 4, wherein the difference in vertical dimension between said protrusion and said recess is from 10 mm to 70 mm.

6. A bipolar electrolytic cell according to claim 1 wherein the height of said protrusion is from 10 mm to 70 mm.

7. A bipolar electrolytic cell comprising an anode, a cathode, and an anode-side partition having a protrusion on the anode side, said protrusion being electrically connected to the anode through conductive members, wherein the ratio of a total area of the protrusion to an effective electrolytic area is within the range of from not less than 5 % to not more than 60%.

8. A bipolar electrolytic cell according to claim 7, wherein said conductive members being provided between said anode side partition and said anode.

9. A bipolar electrolytic cell according to claim 7, wherein the distance between the protrusion of the anode-side partition and the back surface of said anode ranges from 2 mm to 10 mm.

10. A bipolar electrolytic cell according to claim 7, wherein said anode-side partition has a recess formed by causing said anode-side partition to protrude on the cathode side.

11. A bipolar electrolytic cell according to claim 10, wherein the difference in vertical dimension between said protrusion and said recess is from 10 mm to 70 mm.

12. A bipolar electrolytic cell according to claim 7, wherein the height of said protrusion is from mm to 70 mm.

* * * * *